United States Patent [19]

Hori

[11] 4,436,031

[45] Mar. 13, 1984

[54] SERIAL PRINTER

[75] Inventor: Fumihisa Hori, Tamayama, Japan

[73] Assignee: Alps Electric Co., Ltd., Tokyo, Japan

[21] Appl. No.: 334,544

[22] Filed: Dec. 28, 1981

[30] Foreign Application Priority Data

Dec. 27, 1980 [JP] Japan ..... 55-185990

[51] Int. Cl.[3] ..... B41J 1/50

[52] U.S. Cl. ..... 101/93.17; 400/154.2; 400/185; 400/148; 400/328

[58] Field of Search ..... 400/147, 148, 154.2, 400/154, 328, 320; 101/93.15–93.19

[56] References Cited

U.S. PATENT DOCUMENTS

| | | | |
|---|---|---|---|
| 3,256,969 | 6/1966 | Bretti | 400/154.2 |
| 3,291,042 | 12/1966 | Christoff et al. | 101/93.16 |
| 3,378,127 | 4/1968 | Clary et al. | 400/154.2 |
| 3,403,572 | 10/1968 | Rekewitz | 400/328 |
| 3,482,511 | 12/1969 | Tauchert et al. | 101/93.16 |
| 3,628,645 | 12/1971 | McFeaters et al. | 400/328 |
| 3,651,914 | 3/1972 | Locke | 101/93.18 |
| 3,804,225 | 4/1974 | Ulin | 400/154.2 |
| 3,927,753 | 12/1975 | Donovan et al. | 400/154.2 |
| 3,957,151 | 5/1976 | Kashio | 101/93.18 X |
| 4,051,942 | 10/1977 | Suzuki et al. | 101/93.16 |
| 4,250,807 | 2/1981 | Kondo et al. | 101/93.16 |
| 4,352,576 | 10/1982 | Hori et al. | 101/93.17 |

FOREIGN PATENT DOCUMENTS

| | | | |
|---|---|---|---|
| 2056918 | 3/1981 | United Kingdom | 101/93.15 |

*Primary Examiner*—William Pieprz

*Attorney, Agent, or Firm*—Guy W. Shoup; Gerard F. Dunne

[57] ABSTRACT

A serial printer having a carriage adapted to be shifted in the direction perpendicular to the direction of feed of a printing paper, hammer means opposing to the carriage across the thickness of the printing paper and adapted to be shifted as a unit with the carriage, a type wheel group slidable over a predetermined stroke within the carriage in the direction of shift of the carriage, and shift means for shifting the carriage and the type wheel group in the above-mentioned direction. The serial printer is small-sized and has a compact construction suitable for use in desk-top calculators or the like instruments.

8 Claims, 10 Drawing Figures

SERIAL PRINTER

BACKGROUND OF THE INVENTION

The present invention relates to a serial printer and, more particularly, to a small-sized serial printer having a simplified construction and capable of alpha-numeric printing.

It is a current demand for desk-top calculators to have a multiplicity of functions and higher grade of quality. To cope with this demand, the use of desk-top calculators having a key actuable to select any one of a multiplicity of operations, such as function calculator, programming calculator and so forth is spreading. This also gives rise to a demand for a printer which can be build into these desk top calculators, particularly a printer using type elements which can effect an alpha-numeric printing and ensure a clean printing of data.

SUMMARY OF INVENTION

Accordingly, an object of the invention is to provide a printer which can meet the above-described demands.

To this end, according to the invention, there is provided a serial printer comprising: a carriage adapted to be shifted in the direction perpendicular to the direction of feed of the printing paper; hammer means adapted to be shifted as a unit with the carriage at opposite sides of the printing paper; type wheel means having a plurality of rows of type elements and mounted in the carriage in such a manner as to be able to slide over a predetermined stroke in the direction of shift of the carriage and to rotate; a type holder holding the type wheel means; rotary cam means rotatably held by the type holder and provided with a spiral groove, the rotary cam means being splined to type row selecting shaft means; guiding means engaging the spiral groove of the rotary cam means and mounted on the carriage, the guiding means being adapted to move the type holder holding the rotary cam means within the carriage as the rotary cam means rotates thereby to successively bring the type rows of the type wheel means to the position confronting the striking surface of the hammer means.

The above and other objects, as well as advantageous features of the invention will become clear from the following description of the preferred embodiments taken in conjunction with the accompanying drawings.

Figure 1:
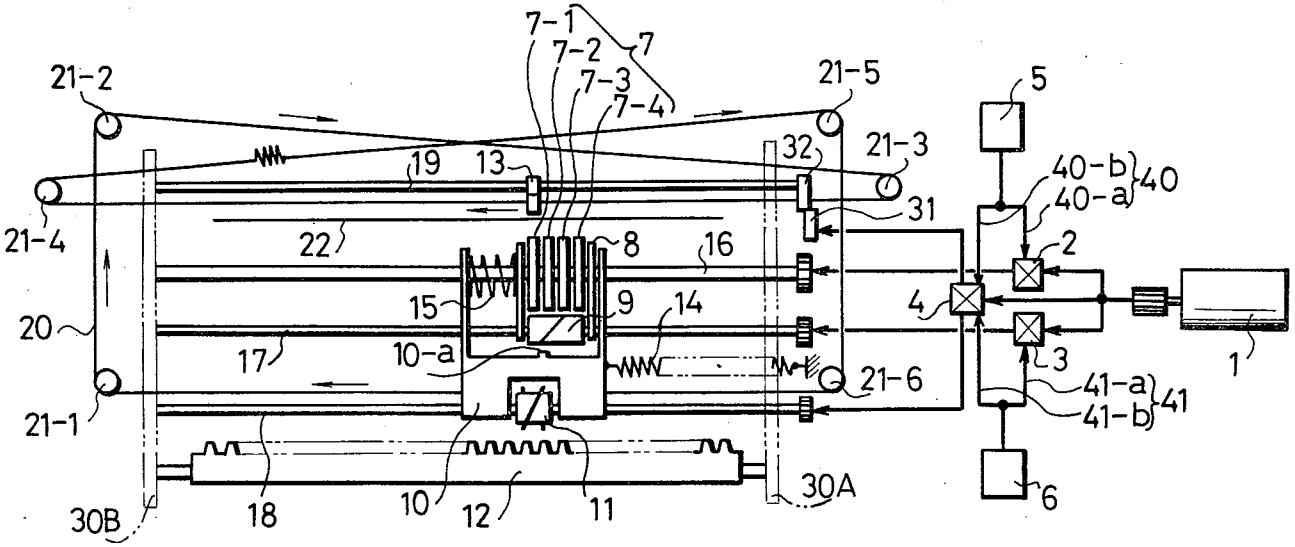
FIG. 1 is a simplified illustration of a serial printer in accordance with an embodiment of the invention.
Figure 3:
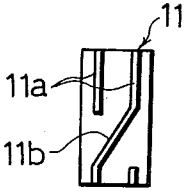
Figure 4:
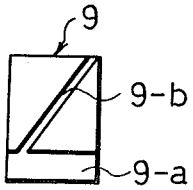

FIGS. *2a* to *2d* are illustrations of the shift selection operation for a group of type wheels in the serial printer shown in FIG. 1;

FIG. 3 is a developed view of a carry cam;

FIG. 4 is a developed view of a type wheel selection cam; and

FIGS. *5a* to *5c* are illustrations of operation for switching the state of a clutch.

DESCRIPTION OF THE PREFERRED EMBODIMENTS

Referring to the drawings, a printer in accordance with the illustrated embodiment of the invention has a frame having a part constituted by two opposing side plates 30A,30B between which are rotatably held a type shaft 16, type wheel selection cam shaft 17, carry cam shaft 18 and a hammer shaft 19.

The type shaft 16, type wheel selection cam shaft 17 and the carry cam shaft 18 in cooperation carry a carriage 10 which is slidable in the column direction across a line to be printed and is always biased to reset towards its initial position by a reset spring 14. The following parts are mounted in the carriage 10: a group 7 of type wheels splined to the type shaft 16; a type wheel selection cam 9 splined to the type wheel selection cam shaft 17 and engaging a projection 10-*a* of the carriage 10; a type holder 8 slidable by a predetermined stroke in the axial direction of the type shaft 16 and holding the type wheel group 7 and the type wheel selection cam 9; a type spring 15 adapted to act to reset the type holder 8 to the initial position; and a carry cam 11 splined to the carry cam shaft 18 and engaging a rack 12.

A hammer 13 opposing the type wheel group 7 across the thickness of a printing paper 22 is splined to the hammer shaft 19 and is adapted to move in synchronization with the movement of the carriage 10 in the same direction as the latter. To this end, the hammer 13 is connected to the carriage 10 through a wire 20 going in an endless manner round wire rollers 21-1, 21-2, 21-3, 21-4, 21-5 and 21-6, as shown in FIG. 1. The wire 20 is connected to the centers of mass of the carriage 10 and the hammer 13 by suitable connecting means.

A motor 1 has a shaft adapted to rotate only in one direction. The motor output derived from this shaft is transmitted to the type shaft 16 through a clutch 2, to the type wheel selection shaft 17 through a clutch 3 and to the carry shaft 18 and the hammer shaft 19 through a clutch 4. The control of the states of the clutches 2,4 is performed by a solenoid 5, while a solenoid 6 effects the control of the states of the clutches 3 and 4. The torque-transmissible state of each clutch will be referred to as ON state, while the state of non-torque transmission will be referred to as OFF state, hereinunder. The clutch 2 takes the ON state and OFF state, respectively, when the solenoid 5 is not energized and when the same is energized. The clutch 3 takes the ON and OFF states, respectively, as the solenoid 6 is energized and de-energized. The clutch 4 takes the ON state only when the solenoid 5 is energized while the solenoid 6 is de-energized.

In the above-described construction, in the state preparing for the commencement for printing of a line, the carriage 10 is reset by the reset spring 14 at the home position close to the side plate 30A as viewed in FIG. 1, while the type wheel group 7 in the carriage 10 takes a reference position which is the rightmost position as viewed in FIG. 1. As the motor 1 starts to rotate in accordance with an instruction for printing of one line, the torque of the motor 1 is transmitted only to the type shaft 16, because at this moment the solenoids 5 and 6 are kept de-energized to keep the clutch 2 in ON state and the clutches 3,4 in OFF state.

Figures 2A, 2B, 2C, 2D:
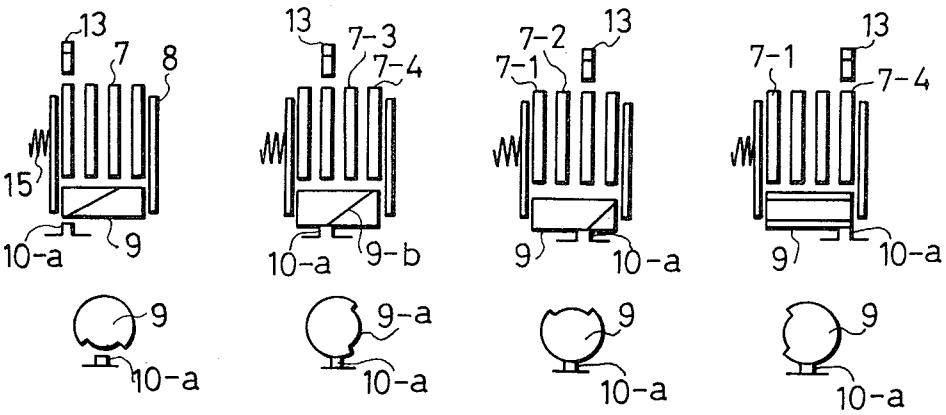

As the motor speed becomes steady, the solenoid 6 is energized if it is necessary to shift the type wheel group 7 in the axial direction, so that the clutch 3 is turned into ON state to make the type wheel selection shaft 17 rotate together with the type shaft 16. Although not shown, there is provided an ink roller mounted on the carriage 10 and adapted to apply the outer peripheral surface of the type wheel group 7 as the type shaft 16 rotates. As the type wheel selection cam shaft 17 starts to rotate, the type wheel selection cam 9 also starts to rotate. As shown in the developed view in FIG. 4, the type wheel selection cam 9 is provided in its outer peripheral surface with a cam surface consisting of a recessed part 9-*a* extending over a quarter ($\frac{1}{4}$) of the circumference and a spiral groove portion 9-*b* extending over the remainder $\frac{3}{4}$ of the circumference, as will be most clearly seen from FIG. 2. In the initial or beginning period of operation, the projection 10-*a* of the carriage 10 rests in the recess 9-*a* so that the type holder 8 and, hence, the type wheel group 7 are held by the type spring 15 at positions shown in FIG. 1 where the hammer 13 is confronted by the type wheel 7-1 of the group 7. As the type wheel selection cam 9 makes a 90° rotation from this position, the groove 9-*b* is brought into engagement with the projection 10-*a* of the carriage 10 so that the type holder 8 is moved to the left overcoming the force of the type spring 15 to bring the type wheel 7-2 to the position confronting the hammer 13, as shown in FIG. 2*b*. As the type wheel selection cam 9 makes a further 90° rotation, the type wheel 7-3 is brought to the position facing the hammer. Similarly, the type wheel 7-4 is brought to this position by a still further 90° rotation of the type wheel selection cam 9, as will be seen from FIGS. 2*c* and 2*d*. Thus, by an additional 90° rotation, i.e. a full 360° rotation of the type wheel selection cam 9, the recess 9-*a* of this cam is brought again into engagement with the projection 1-*a* of the carriage. In consequence, the type holder 8 released from the groove portion 9-*b* of the cam is moved to the right as viewed in the drawings to resume the home position (reference position) shown in FIG. 2*a* where the hammer 13 is opposed by the type wheel 7-1. This operation is repeated in accordance with the rotation of the type wheel selection cam 9.

Therefore, as the solenoid 6 is de-energized just before the type wheel having the desired type element is brought to the position facing the hammer 13, the clutch 3 is turned to OFF state so that the power transmission to the type wheel selection cam shaft 17 is interrupted to stop the type holder 8 at a position with the type wheel having the desired type element confronting the hammer 13.

On the other hand, as the solenoid 5 is energized immediately before the desired type element in the type wheel group 7 is brought to the position confronting the hammer 17 so that the clutch 2 is turned to the OFF state and the type shaft 16 is disconnected from the output of the motor 1 to make the desired type element stop at the position confronting the striking portion of the hammer 13.

The sequence of selection, i.e. whether the shift selection (selection of axial position) or the rotary position of the type wheel group 7 is to be made first does not matter. This sequence depends on various factors such as the position of the type element to be selected and transmission ratios between the motor 1 and respective shafts 16,17. In either event, these two kinds of selection are achieved sequentially with a small phase difference, and the clutch 4 is kept in OFF state until both of these selection motions are completed.

After the completion of selection of the axial position and rotary position of the type wheel group 7, the solenoid 5 is energized while the solenoid 6 is de-energized so that the clutch 4 is for the first time turned to the ON state so that the hammer shaft 19 is driven by later-mentioned cam and lever. At the same time, the carry cam starts to rotate by a power transmitted through a gear train. The arrangement is such that the solenoid 5 is de-energized immediately after the turning ON of the clutch 4 while the latter is automatically turned to OFF state as the driven side of the same makes a half revolution.

Figure 5C:
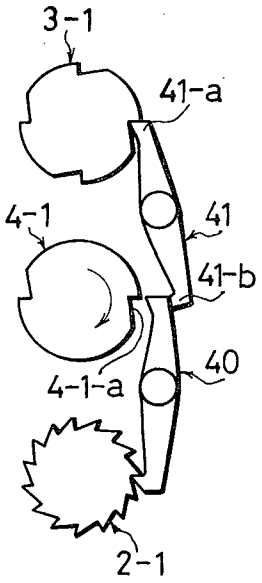
Figure 5B:
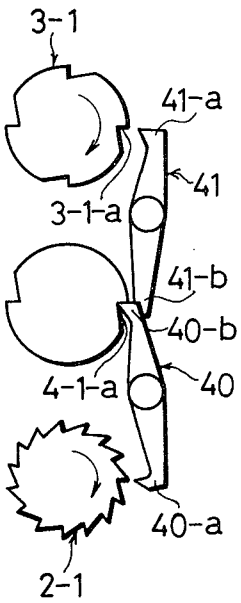
Figure 5A:
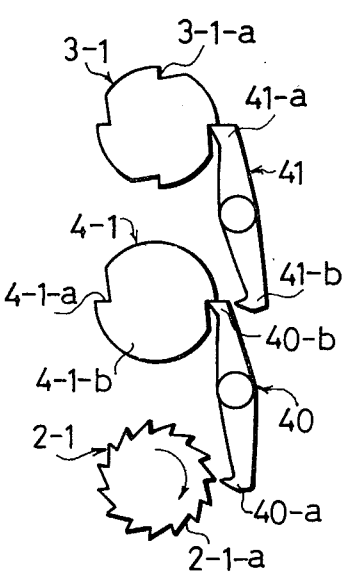

Namely, as shown in FIG. 5, the clutch 4 has a control disc 4-1 for controlling the clutch 4 to and from OFF and ON states. The control disc 4-1 is a disc provided with grooves 4-1-*a* at an 180° interval. An operation lever 40 adapted to be controlled by the solenoid 5 has one end engageable with a groove 4-1-*a*. The grooves 4-1-*a* are adapted to be engaged also by one end 41-*b* of another operation lever 41 under the control of the solenoid 6. The clutch 4 can take the ON state only when both of the ends 40-*b*,41-*b* of both levers are kept out of engagement with the groove 4-1-*a* as will be seen from FIG. 5*c*, to permit the driven side of the clutch to rotate. A spring (not shown) bias one end 40-*b* of the lever 40 into pressure contact with the outer periphery of the control disc 4-1 and the other end 40-*a* of the same away from a control ratchet 2-1 which constitutes a part of the driven side of the clutch 2. As the solenoid 5 is energized, the lever 40 is rotated to disengage its end 40-*b* from the groove 4-1-*a* of the control disc 4-1 while bringing the other end 40-*b* into engagement with the teeth 2-1-*a* of the control ratchet 2-1 of the clutch 2 thereby to turn the clutch 2 OFF. Therefore, as the clutch 4 is turned to the ON state to rotate the driven side thereof including the control disc 4-1, the end 40-*b* of the lever 40 is pressed onto the outer periphery 4-1-*b* of the control disc 4-1 while the other end 40-*a* is kept in engagement with the teeth 2-1-*a* of the control ratchet 2-1 of the clutch 2, if the solenoid 5 is de-energized. Therefore, as the end 40-*b* of the lever 4 is placed into the new groove 4-1-*a* of the control disc 4-1 after 180° rotation of the latter, the other end 40-*a* is moved out of engagement with the teeth of the control ratchet 2-1 of the clutch 2 to turn the latter into the ON state while turning the clutch 4 into the OFF state.

In the state where the clutch 4 is not yet turned into the ON state while the solenoid 6 is de-energized, the end 41-*b* of the lever 41 opposes but is spaced from the groove 4-1-*a* of the control disc 4-1 which constitutes a part of the driven side of the clutch 4 and the other end 41-*a* of the same lever 41 is biased by a spring into engagement with the groove 3-1-*a* of a control disc 3-1 of the clutch 3. The clutch 3 in this state, therefore, takes the OFF state as will be seen from FIG. 5*a*. As the solenoid 6 is energized in this condition, the lever 41 is rotated against the force of the spring to bring one end 41-*b* thereof into engagement with the groove 4-1-*a* of the control disc 4-1 of the clutch 4 while moving the other end 41-*a* thereof out of engagement with the groove 3-1-*a* of the control disc 3-1 of the clutch 3 to turn the latter ON. In the state shown in FIG. 5*b*, both of the clutches 3 and 4 take the ON state.

Thereafter, the solenoid 6 is de-energized in accordance with the type wheel group shift position selection instruction, so that the end 41-*b* of the operation lever 41 is moved out of engagement with the groove 4-1-*a* of the control disc 4-1 of the clutch 4, while the other end 41-*a* of the same is placed into engagement with the control disc 3-1 of the clutch 3 to turn the latter to OFF state. Therefore, the clutch 4 is never turned to the ON state until both of the shift selection and rotational selection of the type wheel group 7 are completed. In addition, as the control disc 4-1, i.e. the driven side, of the clutch 4 makes a half revolution after turning of the clutch 4 into the ON state, the group of clutches resumes the initial condition. Although it is believed that the arrangement of the levers 40,41, control discs of clutches, control ratchet and so forth is readily understood from the foregoing description by those skilled in the art, reference shall be made as necessitated to the specification of U.S. patent application Ser. No. 299,551 filed Sept. 4, 1981 in which an example of the arrangement is shown and described.

As the clutch 4 is turned to the ON state as a result of a series of operations mentioned above, a lever 32 of the hammer 19 contacting a cam 31 constituting a part of the driven side of the clutch 4, is driven by a ¼ revolution of the cam 31, so that the hammer shaft 19 is rotated to rock the hammer 13 around the axis of the hammer shaft 19 to press the printing paper 22 against the selected type element. After this printing, the hammer shaft 19 is reset to the initial position by the force of a spring which is not shown. This printing operation is completed in the earlier half part of the half revolution of the driven side of the clutch 4, i.e. in the beginning ¼ revolution of the driven side of the clutch 4.

The carry cam shaft 18 continues to rotate even during the above-described printing operation. The outer peripheral surface of the carry cam 11 is divided into two regions: namely a rail region 11-*a* consisting of a rail parallel to the circumferential line and a spiral rail region 11-*b* which substantially performs the carrying operation. The carry cam 11 is adapted to make a half revolution as the driven part of the clutch 4 makes a half revolution.

Therefore, in the period of the beginning ¼ revolution of the driven side of the clutch 4, i.e. during the hammering operation, the carry cam 11 does not move axially if the rail portion 11-*a* of the latter is kept in engagement with the rack 12, so that the carrying operation of the carriage 10 is not achieved. In the subsequent ¼ revolution of the driven side of the clutch 4, i.e. in the latter half part of the half revolution of the same, the rail portion 11-*b* of the carry cam comes into engagement with the rack 12 so that the carry cam 11 is moved to the left as viewed in FIG. 1 along the rack 12 to shift the carriage 10 by one pitch to make the carry operation. As the carriage 10 is moved to the left by a desired distance as a result of the operation of the carry cam 11, the wire 20 which is connected between the carriage 10 and the hammer 13 is pulled to shift the latter in the same direction as the movement of the carriage 10 by the same distance as the latter to stop at a position preparing for the next printing action.

After the completion of the printing of the first column and a subsequent carrying operation, the solenoid 6 is energized again so that, after the selection of axial position and rotational position of the type wheel group 7 for the second column, the hammering action and the carrying operation are performed in the same manner as described above. This cycle of operation is repeated to finish the printing over one line. Thereafter, the rack 12 is rotated by suitable means so that the carry cam 11 is disconnected from the rack 12 to permit the carriage 10 to be reset to the home position by the force of the reset spring 14.

As has been described, according to the invention, the carriage and the hammer, which oppose to each other across the thickness of the printing paper, are adapted to be moved together in the same direction, and the type wheel group is shifted within the carriage in the axial direction to bring the desired type to the position facing the hammer. It is, therefore, possible to effect a printing of a multiplicity of characters such as alpha-numeric symbols, in a type-printing serial printer having a simple construction. In addition, it becomes possible to shift the hammer and the carriage by a common power source. Thus, the size of the serial printer as a whole is remarkably reduced to make the serial printer more suitable for use in portable desk-top calculators or the like instruments.

What is claimed is:

1. A printer including a carriage adapted to be moved along a line to be printed and carrying a holder containing a plurality of circumferential rows of type elements, impact means including a hammer movable along the line to be printed in unison with said carriage for pressing a record medium between said hammer and a selected one of said type elements placed in a printing position along the line to be printed, and selection means for selectively sliding said rows of type elements laterally within said carriage for bringing a selected one of said rows into said printing position, said selection means including a rotary cam carried by said holder and including spiralling cam portion and a return cam portion, a guide portion held to said carriage and adapted to engage said cam portions and means including a cam shaft connected to said cam for rotating said cam so that said guide portion can slide along said cam portions to shift said holder laterally from its home position within said carriage to selectively bring said rows into said printing position and then return said holder to its home position within said carriage by rotating said shaft in a single direction, means including a type shaft extending thorugh said rows of type elements for rotating them to bring a selected angular position of said rows along said printing position, means including a column shaft for shifting said carriage along the line to be printed, means including a single motor for providing motive power to each of said cam shaft, said rotary shaft and said column shaft, means including a first clutch for transmitting motive power selectively from said motor to said type shaft, means including a second clutch for transmitting motive power selectively from said motor to said cam shaft, and means including a third clutch for transmitting motive power to said column shaft when said first and second clutches are not transmitting motive power to said type shaft and said cam shafts respectively.

2. A printer according to claim 1, said return cam portion including a straight cam portion extending generally parallel to the line to be printed, and means including a spring biasing said holder to its home position.

3. A printer according to claim 1, means including a single wire element connected to both said carriage and said hammer for moving them in unison.

4. A printer according to claim 1, said motor being a unidirectional motor.

5. A printer according to claim 1, means including a hammer shaft for moving said hammer towards the selected type element in said printing position, and means including said third clutch for transmitting motive power from said motor to said hammer shaft.

6. A printer according to claim 5, said means including a third clutch further including means for delaying the shifting of said carriage until after the movement of said hammer.

7. A printer including a carriage adapted to be moved along a line to be printed and carrying a holder containing a plurality of circumferential rows of type elements, impact means including a hammer movable along the line to be printed in unison with said carriage for pressing a record medium between said hammer and a selected one of said type elements placed in a printing position along the line to be printed, and selection means for selectively sliding said rows of type elements laterally within said carriage for bringing a selected one of said rows into said printing position, said selection means including a rotary cam carried by said holder and including spiralling cam portion and a return cam portion, a guide portion held to said carriage and adapted to engage said cam portions and means including a cam shaft connected to said cam for rotating said cam so that said guide portion can slide along said cam portions to shift said holder laterally from its home position within said carriage to selectively bring said rows into said printing position and then return said holder to its home position within said carriage by rotating said in a single direction, means including a type shaft extending thorugh said rows of type elements for rotating them to bring a selected angular position of said rows along said printing position, means including a hammer shaft for moving said hammer towards the selected type element in said printing position, means including a single motor for providing motive power to each of said cam shaft, said rotary shaft and said hammer shaft, means including a first clutch for transmitting motive power selectively from said motor to said type shaft, means including a second clutch for transmitting motive power selectively from said motor to said cam shaft, and means including a third clutch for transmitting motive power to said hammer shaft when said first and second clutches are not transmitting motive power to said type shaft and said cam shaft, respectively.

8. A printer according to claim 7, said motor being a unidirectional motor.

* * * * *